US009528369B2

(12) United States Patent
Brown

(10) Patent No.: US 9,528,369 B2
(45) Date of Patent: Dec. 27, 2016

(54) PRODUCTION LOGGING TOOL AND METHOD FOR ANALYZING A PRODUCED FLUID

(75) Inventor: Christopher P. Brown, Flower Mound, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1194 days.

(21) Appl. No.: 13/326,325

(22) Filed: Dec. 15, 2011

(65) Prior Publication Data

US 2013/0158875 A1 Jun. 20, 2013

(51) Int. Cl.

| | |
|---|---|
| ***G01V 3/18*** | (2006.01) |
| ***G01N 33/28*** | (2006.01) |
| ***E21B 47/10*** | (2012.01) |

(52) U.S. Cl.

CPC ..... *E21B 47/10* (2013.01); *E21B 47/1015* (2013.01)

(58) Field of Classification Search

CPC ..... G01V 3/18; G01N 33/2823; G01N 33/28
See application file for complete search history.

(56) References Cited

U.S. PATENT DOCUMENTS

| | | | | |
|---|---|---|---|---|
| 3,841,419 | A * | 10/1974 | Russell | 175/40 |
| 4,904,603 | A | 2/1990 | Jones et al. | |
| 5,661,237 | A | 8/1997 | Dussan V., et al. | |
| 5,663,499 | A | 9/1997 | Semmelbeck et al. | |
| 6,263,729 | B1 | 7/2001 | Catala | |
| 6,747,270 | B2 * | 6/2004 | Pereira et al. | 250/269.4 |
| 6,908,888 | B2 | 6/2005 | Lee et al. | |
| 6,925,392 | B2 | 8/2005 | McNeil, III et al. | |
| 6,938,469 | B2 | 9/2005 | Ganesan | |
| 7,303,009 | B2 | 12/2007 | Al-Muraikhi | |
| 7,933,018 | B2 | 4/2011 | Vannuffelen et al. | |
| 8,024,122 | B2 | 9/2011 | LeCompte et al. | |
| 2004/0159149 | A1 * | 8/2004 | Williams et al. | 73/152.23 |
| 2010/0025110 | A1 * | 2/2010 | John et al. | 175/27 |
| 2010/0214120 | A1 | 8/2010 | Means et al. | |
| 2011/0249266 | A1 | 10/2011 | Kumar | |

FOREIGN PATENT DOCUMENTS

| | | |
|---|---|---|
| GB | 2449933 | * 10/2008 |
| WO | 2010/097782 | 9/2010 |

OTHER PUBLICATIONS

"Chloride in Groundwater and Surface Water in Areas Underlain by the Glacial Aquifer System, Northern United States" (U.S. Department of the Interior, U.S. Geological Survey (2009).*

Schlumberger Brouchure, "PS Platform, Production logging with confidence", Sep. 1999.

Schlumberger Brouchure, "FloView Holdup Measurement Tool," Aug. 2004.

International Search Report for the equivalent PCT patent application No. PCT/US12/69988 issued on Feb. 26, 2013.

* cited by examiner

*Primary Examiner* — Andrew Schechter
*Assistant Examiner* — Robert Dewitty
(74) *Attorney, Agent, or Firm* — Michael Dae

(57) ABSTRACT

Disclosed are a production logging tool and method for evaluating fluid produced from a formation of an oilfield. The fluid is measured by a water sensor to determine if the fluid is water, and a chloride sensor to determine chloride levels of the fluid. Based on the chloride levels of the fluid, it can be determined whether the fluid is naturally occurring water, or if the fluid is an injection fluid.

20 Claims, 5 Drawing Sheets

PRODUCTION LOGGING TOOL AND METHOD FOR ANALYZING A PRODUCED FLUID

BACKGROUND

The present disclosure relates to techniques for performing fluid analysis. More particularly, the present disclosure relates to techniques, such as production logging, for performing fluid analysis of downhole fluids to detect, for example, chloride content.

Oilfield operations, such as drilling, completion, stimulation, production and/or other operations, may be used to locate and produce valuable hydrocarbons. Production operations may be used to draw located fluids from downhole locations through a wellbore and to surface facilities. Stimulation operations may be performed to facilitate production of fluids from downhole reservoirs. During stimulation, injection fluids may be pumped into surrounding formations to fracture the formation and create pathways for fluid flow. During production, fluid flowing from the formations and into the wellbore may contain a variety of downhole fluids, such as oil, gas, water, etc., and suspended solids. In some cases, such as when operating in certain mature oilfields, the produced fluid may be rich in water.

Production logging can be performed for monitoring the performance and health of a producing well. Such production logging may be used to determine dynamics and nature of the fluids flowing into the wellbore. Interpretation of data captured during production logging can be used to provide information on a wide variety of aspects of the wellbore. The information gathered may be generated on a production log.

Production logs may be used to record, for example, one or more in-situ measurements taken during a production operation. These production logs may describe the nature and behavior of fluids in or around the wellbore. Production logs can provide, for example, information about dynamic well performance, and the productivity or injectivity of different zones. This information may be used to help diagnose problem wells, or monitor the results of one or more oilfield operations.

Various downhole tools can be used for performing production logging. One or more downhole tools, such as flowmeters (e.g., spinners), local probes, nuclear logging tools, phase-velocity logging tools, production logging sensors, etc., may be used to take downhole measurements used to produce the production logs. Such downhole measurements may be used to measure various downhole parameters, such as temperature, flow rate, density, phase velocity, phase holdup, global pipe quantity, mixture density, mixture velocity, water holdup, water velocity, gas holdup, pipe averaged measurement, and the like.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A production logging tool and method is disclosed for determining chloride content of a fluid produced from a formation in an oil field. The method involves determining whether the fluid is water or a hydrocarbon with a measurement of a water sensor on a production logging tool, and determining a chloride content of the fluid with a measurement of a chloride sensor on a production logging tool. Based on a level of the chloride content of the fluid, the method can include determining whether the fluid is naturally occurring in the formation or an injection fluid. The water sensor may be a capacitive water holdup probe, and the measurement is a water holdup measurement. The chloride sensor may be a fluid resistivity sensor, and the measurement is a measurement of a resistivity of the fluid, or a neutron capture cross-section sensor, and the measurement is a measurement of a sigma of the fluid.

BRIEF DESCRIPTION OF THE DRAWINGS

Embodiments of a production logging tool and method for evaluating a produced fluid are described with reference to the following figures. Like numbers are used throughout the figures to reference like features and components.

DETAILED DESCRIPTION

In the following description, numerous details are set forth to provide an understanding of the present disclosure. However, it will be understood by those skilled in the art that the present disclosure may be practiced without these details and that numerous variations or modifications from the described embodiments are possible.

The disclosure relates to a production logging tool and method for determining chloride content of produced fluid. The production logging tool may be provided with a water sensor, such as a water holdup probe, for determining if water is present in the produced fluid. A water holdup profile represents the flow regime in the wellbore. If water is present, an additional sensor may be used to determine the chloride content of the produced fluid. The additional sensor may be, for example a resistivity or neutron capture sensor, for determining whether the produced water is water introduced into the wellbore during a stimulation process, or water from the formation being produced from the wellbore.

Figure 1:
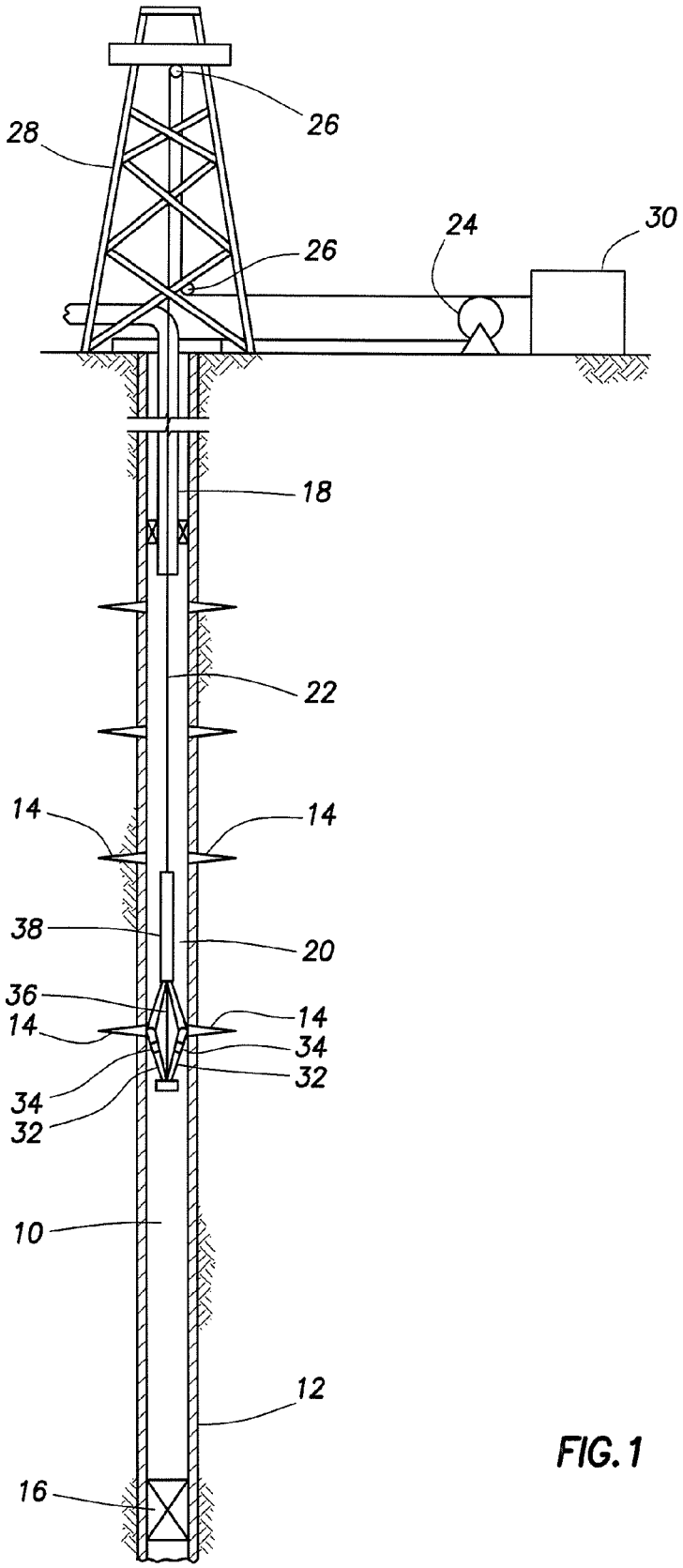
FIG. 1 is a schematic diagram showing an example of a wellsite in which an embodiment of the present disclosure may be used.

In FIG. 1, reference 10 designates an oilwell in production. The wellbore 10 is defined by casing 12 that is provided with perforations 14 via which the wellbore communicates with at least one underground hydrocarbon reservoir. The perforations 14 are located between a plug 16 which closes off the bottom of the wellbore and a bottom end of a production string 18 via which a multi-phase petroleum fluid flows to the surface. The fluid may include, for example, two phases or three phases, e.g., liquid petroleum, gas, and water.

A production logging tool 20 may be deployed into the wellbore 10 in a portion situated between the plug 16 and the bottom end of the production string 18. The logging tool 20 may be used to monitor production parameters of the wellbore 10 as they vary over time. The production logging tool 20 can be inserted in the wellbore 10, or in production fluid line conveyed on, for example, a wireline, slickline, coiled tubing or towed by a tractor.

The production logging tool 20 may be centered on an axis of the wellbore 10 by arms 32 extendable from a body 38 of the production logging tool 20. The arms 32 may be maintained in abutment against the casing 12 of the wellbore 10 when in an extended position. By way of non-limiting illustration, the production logging tool 20 may, in particular, be implemented as the FLOSCAN IMAGER™ (or FSI™) commercially available from SCHLUMBERGER™ (e.g., for use in horizontal or deviated wells), or as the PS Platform™ commercially available from SCHLUMBERGER™ (e.g., for use in vertical wells).

In the wireline embodiment depicted in FIG. 1, the production logging tool 20 is suspended at the bottom end of a cable 22, which passes through the production string 18 to the surface. The opposite end of the cable 22 is wound around a winch 24. Between the winch 24 and the top end of the production string 18, the cable 22 passes over sheaves 26 mounted on a structure 28 overlying the wellbore 10. In a manner well known, means (not shown) may be provided at the surface, in particular for measuring the depth at which the production logging tool 20 is situated, and the velocity at which the production logging tool 20 moves in the wellbore 10 (or alternatively in a production fluid line). The cable 22 may be operatively connected to a surface installation 30 establishing a communication link between the production logging tool 20 and the surface installation 30 for communication therebetween.

The production logging tool 20 can be equipped with various sensors for monitoring the wellbore 10. The arms 32 may support a certain number of local (or measurement) sensors 34. The sensors may be, for example, of an electrical type designed to distinguish between water and hydrocarbon contained in the flow of fluid and/or other sensors, such as fluid resistivity sensors and/or pulsed neutron capture cross-section sensors. In an embodiment of the present disclosure, the local sensors 34 may include at least two different types of sensors, including a water holdup probe, as well as an additional sensor type, as will be described below. The production logging tool 20 may also be provided with other measurement systems such as a spinner flowmeter 36 placed on an axis of the apparatus and making it possible to measure an overall velocity of the fluid in the wellbore 10.

The production logging tool 20 may be used to measure fluid in the wellbore, such as production and/or injection fluid flowing into the wellbore from reservoirs in the formation. In some embodiments, information from the production logging tool 20 (e.g., measurements from the sensors 34 and/or flowmeter 36) may be transmitted to a surface installation 30 via the cable 22 in real time. The surface installation 30 may be provided with equipment enabling the information to be collected, recorded, and processed. In other embodiments, information can be recorded inside the production logging tool 20, for downloading, use and/or processing. When the measurements are relayed to the surface in real time by telemetry via the cable 22, means for recording the results of the measurements (i.e., production logs) are also provided in the surface installation 30. Recorders may optionally be placed inside the production logging tool 20.

Figure 2A:
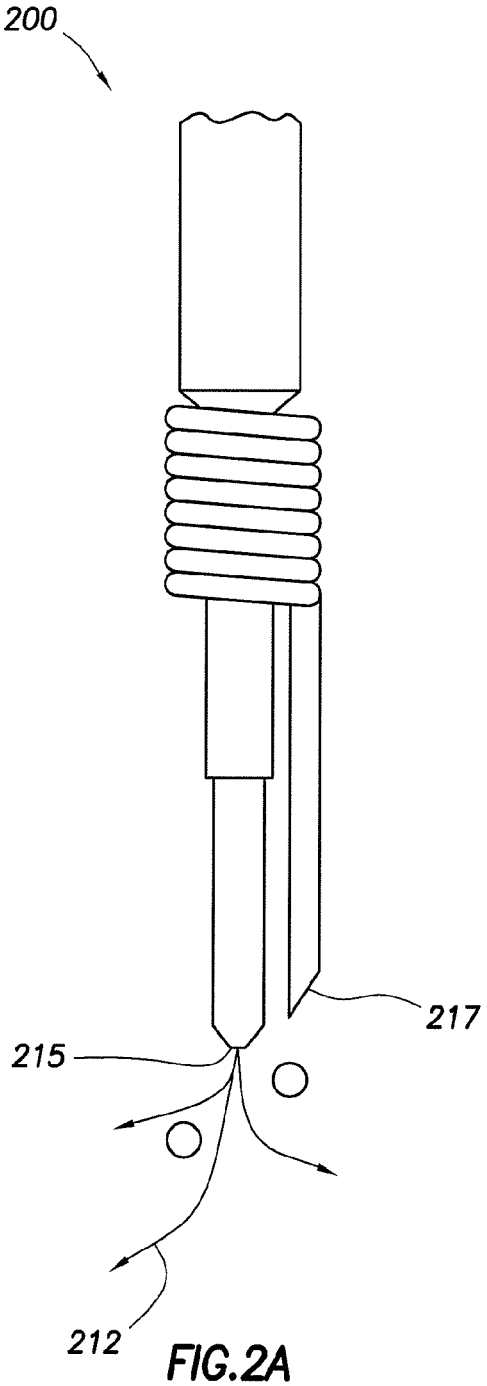
FIGS. 2A and 2B are schematic diagrams illustrating a capacitive electric holdup probe that may be used as a local sensor of a production logging tool in FIG. 1 in an embodiment of the present disclosure.
Figure 2B:
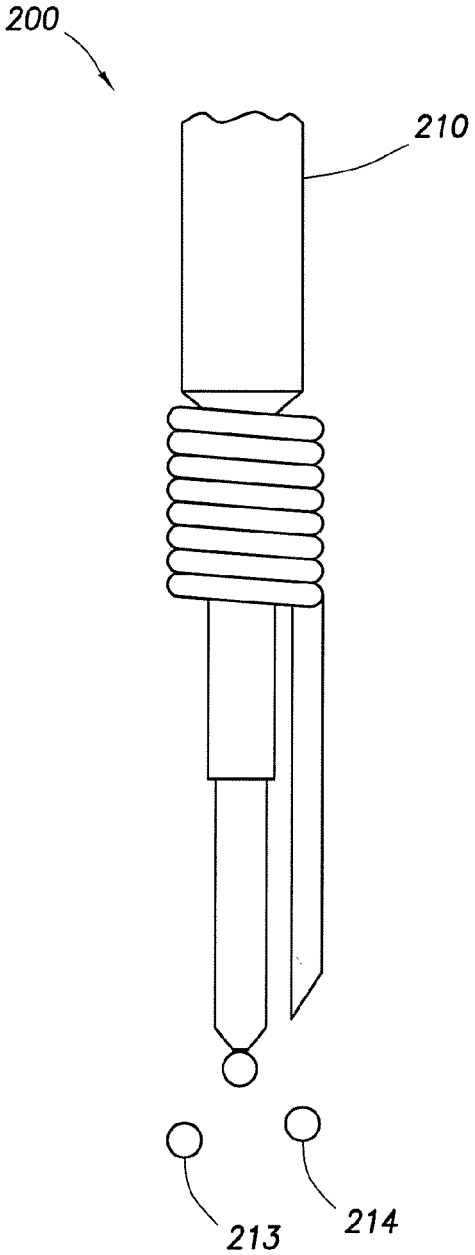

Turning now to FIGS. 2A and 2B, an example of a probe that may be used as a local sensor 34 in the production logging tool 20 to determine whether fluid flow is water or a hydrocarbon is shown. FIGS. 2A and 2B illustrate an example of an electric holdup probe 200 that can measure water holdup in a water continuous phase (or an oil holdup in an oil continuous phase). In an example embodiment, the probe 200 may be a DEFT™ probe commercially available from SCHLUMBERGER™. One or more of the probes 200 may be used with the FLOSCAN IMAGER™ as the sensors 34 shown in FIG. 1.

The presence or absence of an electric current 212 between electrode tips 215 and 217, and an amplitude of the electric current 212 may be an indication of the water (or oil) holdup, depending on the situation. Water holdup can be determined by the fraction of time the probe's tip is conducting. Because water conducts electric current, and hydrocarbons (e.g., oil and gas) do not, a threshold can be set that allows the production logging tool 20 to distinguish hydrocarbons from water. The probes 200 may be used to detect the presence of water, for example, by using six such low-frequency probes to measure fluid impedance. Each probe 200 may be used to generate a binary signal when oil or gas bubbles 213 in a water-continuous phase, or droplets 214 of water in a hydrocarbon-continuous phase, touch the probe's tip as schematically depicted in FIG. 2B.

Figure 3:
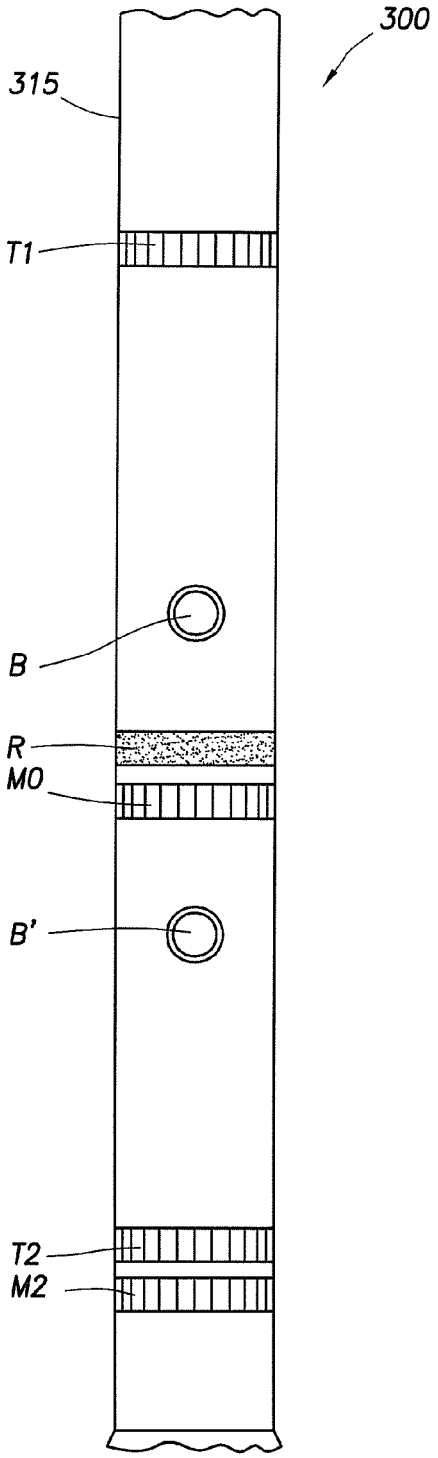
FIG. 3 is a diagram of a fluid resistivity sensor that may be used as a local sensor of a production logging tool in FIG. 1 in an embodiment of the present disclosure.

FIG. 3 illustrates a fluid resistivity sensor 300, usable as a local sensor 34 of the production logging tool 20 of FIG. 1. The resistivity sensor 300 may be used to determine the chloride content level in water detected in produced fluid. Chlorides act as conductors, and thus a resistivity measurement of the impedance of the produced fluid (determined to be water with the probe of FIG. 2, for example) can indirectly provide an indication of the chloride level in the water.

The fluid resistivity sensor 300 may include electrodes disposed on the production logging tool 20, such as a ring electrode R and/or button electrode B. FIG. 3 illustrates an example of a lateral resistivity sensor 300. As shown, the sensor includes two transmitters T1, T2 disposed on a collar 315. Two monitor antennas M0 and M2 are also included. The transmitter (current injector) antennas T1, T2 and the monitor antennas M0, M2 are shown as toroidal coils. The resistivity sensor 300 may also include other electrode receivers, such as a ring electrode R and button electrodes B, B'. The ring electrode R and the button electrodes B and B' are conductive electrodes disposed on the collar 315, and may be electrically isolated from the collar 315 by insulating materials. A ring electrode R may be a conductive metal band disposed around the circumference of the collar 315. The ring electrode R can measure an azimuthally averaged current. On the other hand, button electrodes B and B' can be disposed on one side of the resistivity sensor 300. The button electrodes B and B' can be capable of azimuthal measurements.

Figure 4:
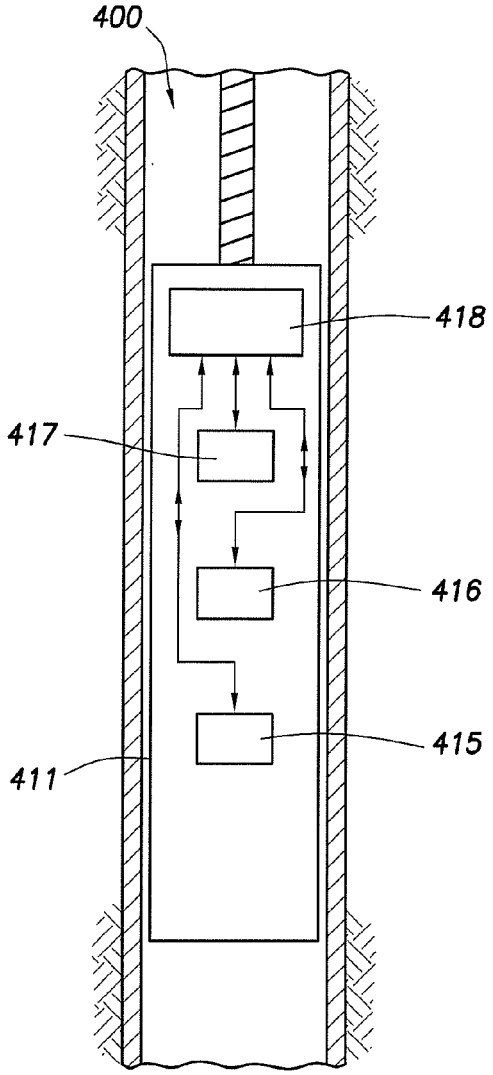
FIG. 4 is a diagram of a pulsed neutron capture cross-section sensor that may be used as a local sensor of a production logging tool in FIG. 1 in an embodiment of the present disclosure.

FIG. 4 illustrates a neutron capture cross-section sensor 400, working in conjunction with a pulsed neutron source, which is another example of a local sensor that may be used in the production logging tool 20 of FIG. 1 to determine the chloride content level in water detected in produced fluid. The neutron capture cross-section sensor 400 includes a neutron source 415 (either a radioactive neutron source that continuously emits neutrons or a pulsed neutron generator) and at least two detectors 416 and 417 (near 416 and far 417 relative to the source 415) in a housing 411. Each detector 416,417 may include a scintillating crystal and a photomultiplier tube (PMT). An optional downhole processor 418 may be included.

The neutron capture cross-section sensor 400 bombards the formation (and produced fluid) with neutrons, and the detectors 416 and 417 measure the neutrons. Due to the interaction between hydrogen and the neutrons, the neutrons that are captured provide some indication of the porosity of the surrounding geological formation. Because chlorides can act as a thermal neutron absorber, the measurements by the detectors may be indicative of chloride levels in the water. Measurements, such as sigma measurements of the decay of the neutrons as they are captured, may also be performed.

Figure 5:
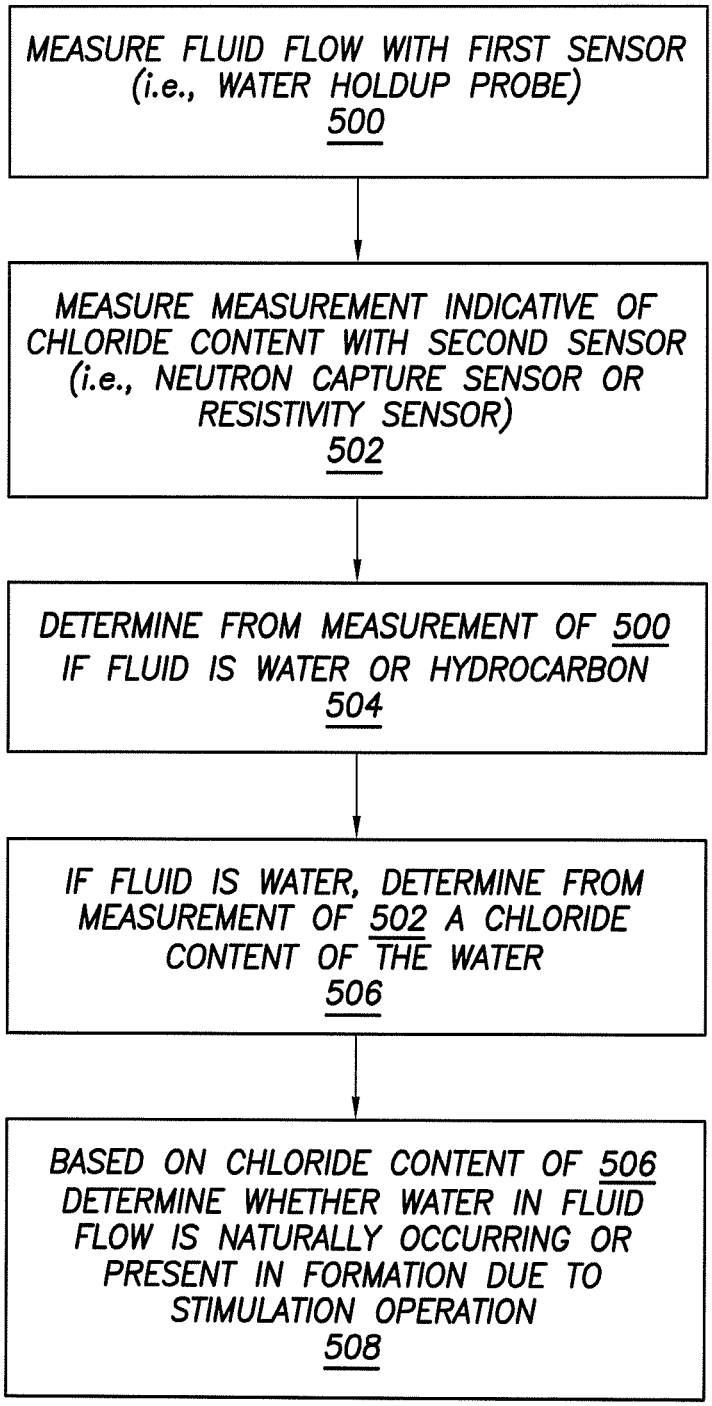
FIG. 5 is a flowchart illustrating a method for evaluating a produced fluid in accordance with an embodiment of the present disclosure.

FIG. 5 illustrates a flowchart of a method in accordance with an embodiment of the present disclosure. The method starts at 500 with measuring a fluid flow with a water sensor, such as a water holdup probe as described above (see, e.g., FIGS. 2A and 2B). The method includes at 502 measuring a measurement indicative of chloride content with a chloride sensor (such as, for example, a neutron capture sensor or fluid resistivity sensor as described above in FIGS. 3 and 4). From the measurement of 500, the method includes at 504 determining whether the fluid flow is water or hydrocarbon. At 506, if the fluid is water, then the method includes determining the chloride content of the water from the measurement obtained in 502. Based on the chloride content determined at 506, the method includes at 508 determining whether water in the fluid flow is naturally occurring (from the formation) or present in the formation artificially, due to stimulation operations. A given level of chloride content may indicate whether the fluid is an injection or other fluid, or naturally occurring water. For example, chloride levels of less than about 20,000 ppm indicates naturally occurring water, chloride levels more than about 25,000-35,000 ppm would indicate an injection fluid or other fluid other than naturally occurring water, chloride levels more than about 80,000 ppm would indicate the fluid is outside of the formation. An alert may be raised if the fluid is found to be over a given level, such as a chloride level of over about 25,000 ppm that indicates an injection fluid is present.

As those with skill in the art will understand, one or more of portions of methods discussed above may be combined and/or the order of some operations may be changed. Further, some operations in methods may be combined with aspects of other example embodiments disclosed herein, and/or the order of some operations may be changed. The process of measurement, its interpretation and actions taken by operators may be done in an iterative fashion; this concept is applicable to the methods discussed herein. Finally, portions of methods may be performed by any suitable techniques, including on an automated or semi-automated basis on computing system 600 in FIG. 6.

Figure 6:
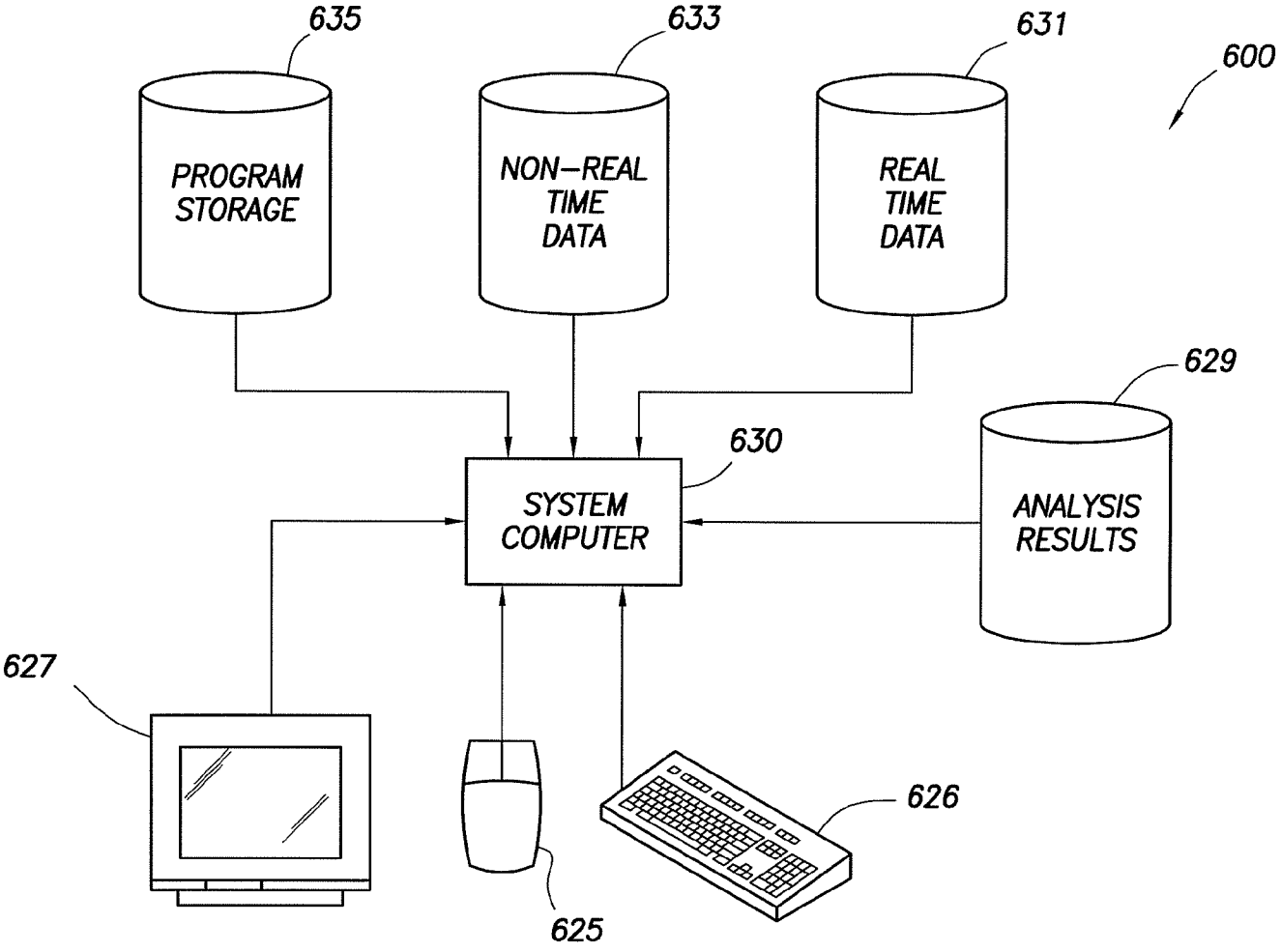
FIG. 6 shows a block diagram of a computer system by which methods disclosed can be implemented.

Portions of methods described above can be implemented in a computer system 600, one of which is shown in FIG. 6. The system computer 630 may be in communication with disk storage devices 629, 631, 633 and 635, which may be external hard disk storage devices and measurement sensors (not shown). It is contemplated that disk storage devices 629, 631, 633 and 635 are conventional hard disk drives, and as such, may be implemented by way of a local area network or by remote access. While disk storage devices are illustrated as separate devices, a single disk storage device may be used to store the program instructions, measurement data, and/or results as desired.

In one implementation, petroleum real-time data from the sensors may be stored in disk storage device 631. Various non-real-time data from different sources may be stored in disk storage device 633. The system computer 630 may retrieve the appropriate data from the disk storage devices 631 or 633 to process data according to program instructions that correspond to implementations of various techniques described herein. The program instructions may be written in a computer programming language, such as C++, Java and the like. The program instructions may be stored in a computer-readable medium, such as program disk storage device 635. Such computer-readable media may include computer storage media. Computer storage media may include volatile and non-volatile, and removable and non-removable media implemented in any method or technology for storage of information, such as computer-readable instructions, data structures, program modules or other data. Computer storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium which can be used to store the desired information and which can be accessed by the system computer 630. Combinations of any of the above may also be included within the scope of computer readable media.

In one implementation, the system computer 630 may present output primarily onto graphics display 627, or via a printer (not shown). The output from computer 630 may also be used to control instruments within the steam injection operation. The system computer 630 may store the results of the methods described above on disk storage 629, for later use and further analysis. The keyboard 626 and the pointing device (e.g., a mouse, trackball, or the like) 625 may be provided with the system computer 630 to enable interactive operation.

The system computer 630 may be located on-site near the wellbore or at a data center remote from the field. The system computer 630 may be in communication with equipment on site to receive data of various measurements. Such data, after conventional formatting and other initial processing, may be stored by the system computer 630 as digital data in the disk storage 631 or 633 for subsequent retrieval and processing in the manner described above. While FIG. 6 illustrates the disk storage, e.g. 631 as directly connected to the system computer 630, it is also contemplated that the disk storage device may be accessible through a local area network or by remote access. Furthermore, while disk storage devices 629, 631 are illustrated as separate devices for storing input petroleum data and analysis results, the disk storage devices 629, 631 may be implemented within a single disk drive (either together with or separately from program disk storage device 633), or in any other conventional manner as will be fully understood by one of skill in the art having reference to this specification.

While the disclosure has been disclosed with respect to a limited number of embodiments, those skilled in the art, having the benefit of this disclosure, will appreciate numerous modifications and variations therefrom. While the disclosure has been described in the context of applications in downhole tools, the apparatus of the disclosure can be used in many applications.

Although a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not simply structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for evaluating a fluid produced from a formation in an oil field, comprising:

determining whether the fluid comprises water or a hydrocarbon with a measurement of a water sensor on a production logging tool;

determining a chloride content of the fluid with a measurement of a chloride sensor on the production logging tool; and based on a level of the chloride content, determining whether the fluid is water naturally occurring in the formation or an injection fluid.

2. The method according to claim 1, wherein the water sensor on the production logging tool comprises a capacitive water holdup probe, and the measurement comprises a water holdup measurement.

3. The method according to claim 1, wherein the chloride sensor on the production logging tool comprises a fluid resistivity sensor, and the measurement comprises a measurement of a resistivity of the fluid.

4. The method according to claim 1, wherein the chloride sensor on the production logging tool comprises a neutron capture cross-section sensor, and the measurement comprises a measurement of a sigma of the fluid.

5. The method according to claim 1, wherein the measurement of the water sensor and the chloride sensor occur simultaneously.

6. The method according to claim 1, further comprising raising an alert when the determining indicates that water in the fluid is the injection fluid.

7. The method according to claim 1, further comprising disposing the production logging tool in one of the wellbore and a production fluid flow line.

8. The method according to claim 1, further comprising correlating the measurements of the water sensor and the chloride sensor in time.

9. The method according to claim 1, wherein determining whether the fluid is water naturally occurring in the formation or an injection fluid comprises determining the fluid is water naturally occurring in the formation if the level of the chloride content is less than approximately 20,000 ppm.

10. The method according to claim 1, wherein determining whether the fluid is water naturally occurring in the formation or an injection fluid comprises determining the fluid is injection fluid if the level of the chloride content is greater than approximately 25,000 ppm.

11. The method according to claim 1, further comprising determining the fluid is outside of the formation if the chloride content is greater than approximately 80,000 ppm.

12. A production logging tool for evaluating a fluid produced from a formation in an oil field, comprising:

a water sensor that obtains a downhole water measurement;

a chloride sensor that obtains a downhole chloride measurement; and a processor that receives the downhole water measurement and determines whether the fluid is water or a hydrocarbon from the downhole water measurement, that receives the downhole chloride measurement and determines a chloride content of the fluid from the downhole chloride measurements, and based on a level of the chloride content of the fluid, determines whether the fluid is naturally occurring in the formation or an injection fluid.

13. The production logging tool according to claim 12, wherein the water sensor on the production logging tool comprises a capacitive water holdup probe, and the measurement comprises a water holdup measurement.

14. The production logging tool according to claim 12, wherein the chloride sensor on the production logging tool comprises a fluid resistivity sensor, and the measurement comprises a measurement of a resistivity of the fluid.

15. The production logging tool according to claim 12, wherein the chloride sensor on the production logging tool comprises a neutron capture cross-section sensor, and the measurement comprises a measurement of a sigma of the fluid.

16. The production logging tool according to claim 12, wherein the processor further correlates the measurements of the water sensor and the chloride sensor in time.

17. The production logging tool according to claim 12, further comprising a conveyance comprising one of a wireline, a slickline, a coiled tubing conveyance, and a tractor.

18. The production logging tool according to claim 12, wherein the processor determines the fluid is naturally occurring in the formation if the level of the chloride content is less than approximately 20,000 ppm.

19. The production logging tool according to claim 12, wherein the processor determines the fluid is injection fluid if the level of the chloride content is greater than approximately 25,000 ppm.

20. The production logging tool according to claim 12, wherein the processor is configured to determine the fluid is outside of the formation if the chloride content is greater than approximately 80,000 ppm.

* * * * *